US006162079A

United States Patent [19]

Slazakowski

[11] Patent Number: 6,162,079

[45] Date of Patent: Dec. 19, 2000

[54] FRONT MOUNTING SOCKET FOR A GAS TUBE LIGHT

[76] Inventor: Kenneth A. Slazakowski, 464 Prospect Ave., Pewaukee, Wis. 53072

[21] Appl. No.: 09/332,221

[22] Filed: Jun. 14, 1999

Related U.S. Application Data

[63] Continuation-in-part of application No. 09/002,769, Jan. 5, 1998, Pat. No. 5,924,882.

[51] Int. Cl.[7] ..... H01R 33/02

[52] U.S. Cl. ..... 439/244; 439/558

[58] Field of Search ..... 439/244, 237, 439/558, 230, 232

[56] References Cited

U.S. PATENT DOCUMENTS

| | | | |
|---|---|---|---|
| 1,958,304 | 5/1934 | Hough | 439/230 |
| 4,842,535 | 6/1989 | Velke, Sr. et al. | 439/232 |
| 5,063,486 | 11/1991 | Cummings, III et al. | 362/217 |
| 5,348,413 | 9/1994 | Sklar | 403/24 |
| 5,354,208 | 10/1994 | Salaski et al. | 439/230 |
| 5,550,724 | 8/1996 | Moulton | 362/267 |

*Primary Examiner*—Paula Bradley
*Assistant Examiner*—Briggitte R. Hammond

[57] ABSTRACT

The present invention provides a front mounting socket for a gas light tube that can be mounted and removed from a sign substrate without requiring access to the rear portion of a sign enclosure. The front mounting socket is installed and removed from the sign surface substrate by turning two diametrically positioned screw members which are a part of the retaining clips. Each retaining clip comprises a retainer member and a screw member supported in a screw groove formed in the socket body and the retainer member defining a retaining surface that engages the sign surface substrate when the operator tightens each screw member until the retainer member abuts the sign substrate, thereby interposing the sign substrate between each retainer member and the retaining surface of the mounting surface which secures the socket to the sign.

12 Claims, 3 Drawing Sheets

FRONT MOUNTING SOCKET FOR A GAS TUBE LIGHT

RELATED APPLICATION

This Application is a continuation-in-part of U.S. application Ser. No. 09/002,769 filed Jan. 5, 1998 now U.S. Pat. No. 5,924,882.

FIELD OF THE INVENTION

The present invention relates to gas light tube signs and more particularly to a front mounting socket for a gas light tube.

BACKGROUND OF THE INVENTION

In a gas light tube fixture such as a neon light sign, the neon gas tube must be installed in a socket so that the electrical current, usually at a high voltage, can excite the gas which in turn produces the light. The neon gas tube is usually formed into various shapes and can be of various sizes. However, each end of the tube must end in a wire terminal or such to facilitate the electrical connection. The tube, by necessity, must be sealed at each end with only the electrode extending into the sealed tube.

The gas tube, usually made from glass, has the ends generally in a straight configuration to facilitate mounting the tube. A socket mounted in the sign surface substrate accepts the end of the gas tube and provides for the necessary electrical connection. The usual socket only provides for a loose fitting placement of the gas tube in the socket. The gas tube is mounted on several separate mounting stands that not only maintains the gas tube in the socket (at each end the gas tube) but also maintains the gas tube away from the sign surface substrate.

The sockets for the gas tubes must be mounted in the sign surface substrate, at positions generally governed by the length of the gas tube used in the sign. Generally an appropriate aperture is made in the sign surface substrate at a convenient location. The prior art sockets are then installed by inserting the main body of the socket into the aperture and securing the socket by threading a ring on the back side of the sign surface substrate. Such an arrangement requires access to the back side and front side of the sign and its sign surface substrate which is inconvenient and affects the integrity of the sign enclosure. This is especially true in signs located in corners or near ceiling/wall joints. U.S. Pat. No. 4,842,535 discloses a gas tube electrode connector which connects the gas tube to a socket but does not teach the attachment of the socket to a sign. U.S. Pat. No. 5,065,486 discloses a mounting apparatus for a fluorescent lamp holder however this apparatus requires the operator to work behind the sign surface substrate 27 when connecting the attachment socket 40. U.S. Pat. 5,354,208 discloses a neon tube connector assembly for J-shaped ends of neon tubes. In this disclosure an enclosure cover must be removed to obtain access to the tube end tip 16 and is limited to J-shaped tubes. U.S. Pat. No. 5,550,724 discloses a housing and cap assembly that facilitates the connection of a neon tube to an electrical cable in two separate, parallel cylinders. This patent does not disclose how the housing and cap assembly is installed in a sign enclosure. U.S. Pat. No. 5,348,413 disclosures a conduit sealing assembly for a neon tube. This assemble facilitates connecting the neon tube to the electrical cable but the cover for the tube/electrical connection is a downward facing glass cup 28. The conduit connection to the sign housing is done with a screw rings 42 and a nut 54 on a sleeve 36.

Existing gas light tubes, such as neon light tubes, have glass sockets which use a rear mounted metal retaining ring threaded on the glass socket. Such socket is easily broken by dropping or over tightening the retaining ring and requires access to the back of the sign surface substrate. Thus there is a continuing need for a front mounting gas light socket that can be easily installed from the front of a sign and without access to the back of the sign.

SUMMARY OF THE INVENTION

The present invention provides a front mounting socket for a gas light tube that can be mounted and removed from a sign substrate without requiring access to the rear portion of a sign enclosure. The front mounting socket having a top portion with a mounting rim a part of which forms an annular mounting surface, a mid portion, and a bottom portion having a wire terminal with said wire terminal in communication with a cavity in the socket body. In the cavity is an electrode contact spring retained in place by a portion of the wire terminal. The socket body is secured to the sign surface substrate by two diametrically positioned retainer clips, each threadedly engaged on a screw member extending from the top portion of the socket body. The socket body can be installed and removed from the sign surface substrate aperture by turning the diametrically positioned retaining clips. Each retaining clip moves on the screw member supported in a screw groove formed in the socket body. When each screw member is tightened, the retainer member moves along the screw member until the retainer member abuts the sign substrate surface, thereby interposing the sign surface substrate between the mounting surface of the front mounting socket and each retainer member.

Another feature of the present invention is that drain holes in the bottom portion of the socket body can be covered with the covers selectively removable by the operator.

The present invention eliminates the need for a door or removable panels in sign housings to access terminals, retaining rings or wiring from the interior of sign enclosures. All work for connecting the wiring to a gas tube socket or installing and removing the socket can be accomplished from the front or outside of the sign enclosure.

The present invention can be molded in or machined from a suitable, dielectric material such as plastic, nylon, or the like, rated for the required temperatures.

Additionally, the present invention is light weight, has few parts, the same material can be used for the socket body and the retainer clip member, and can withstand rough handling.

Other principal features and advantages of the invention will become apparent to those skilled in the art upon review of the following drawings, the detailed description and the appended claims.

Figure 1:
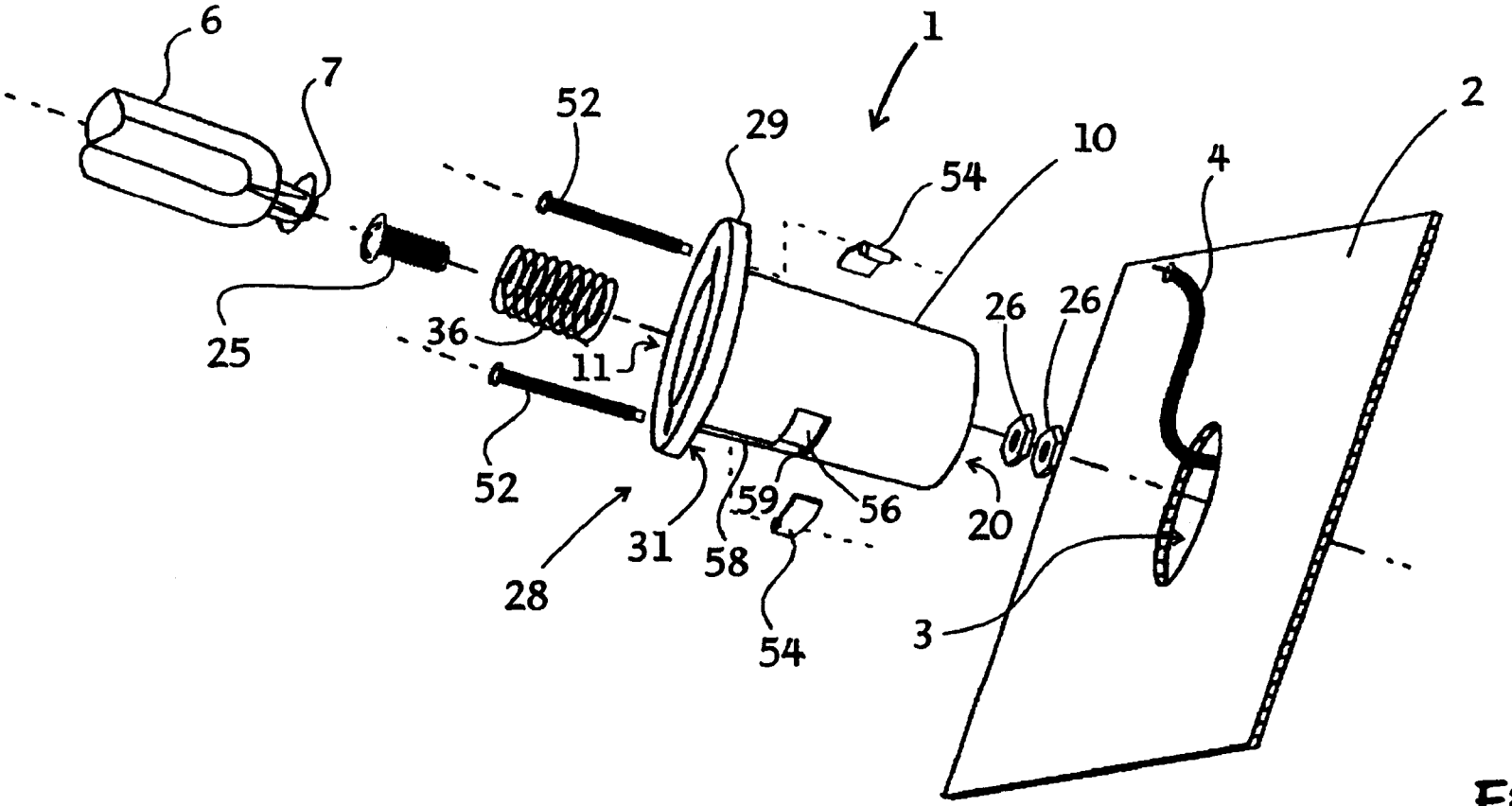
FIG. 1. is a perspective, exploded view of the Front Mounting Socket of the present invention illustrating the retainer clip embodiment.
Figure 3:
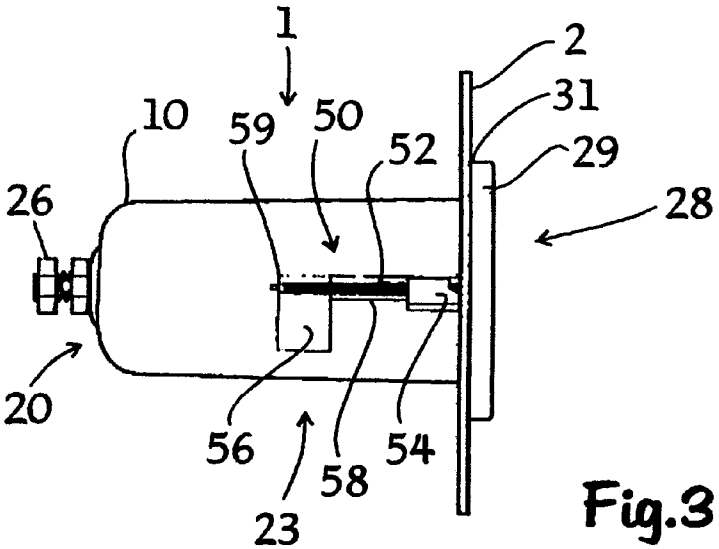
FIG. 3. is a side elevation of the Front Mounting Socket installed in an aperture of a sign substrate with the retainer clip abutting the sign substrate.
Figure 2:
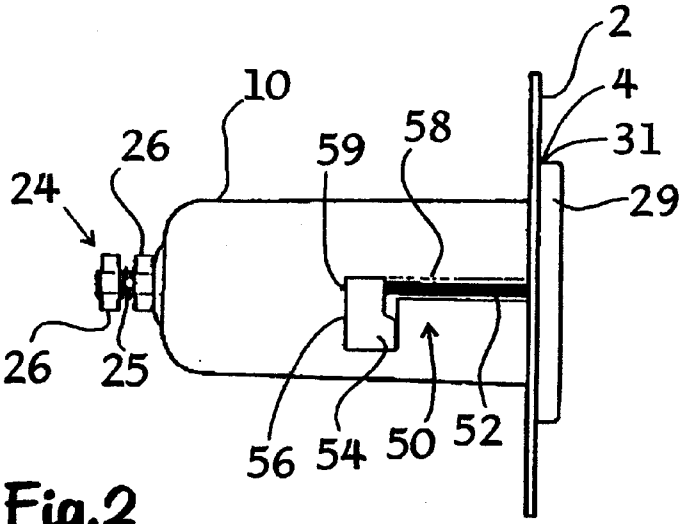
FIG. 2. is side view of the Front Mounting Socket installed in an aperture of a sign surface substrate with the retainer clip nested in a retainer recess in the socket body.

Before explaining the preferred embodiment of the invention in detail, it is to be understood that the invention is not limited in its application to the details of construction and the arrangement of the components set forth in the following description as illustrated in the drawings. The invention is capable of other embodiments or being practiced or carried out in various ways. Also, it is to be understood that the phraseology and terminology employed herein is for the purpose of description and should not be regarded as limiting.

DETAILED DESCRIPTION OF PREFERRED EMBODIMENT

Referring now to FIGS. 1, 2, 3, and 5 there is shown a front mounting socket 1 for a gas light tube 6 which socket 1 is mounted in an aperture 3 of a sign surface substrate 2. A socket body 10 having a top portion 28 and an annular mounting surface 31, a mid portion 23 and a bottom portion 20 comprise the principal item of the present invention.

Figure 4:
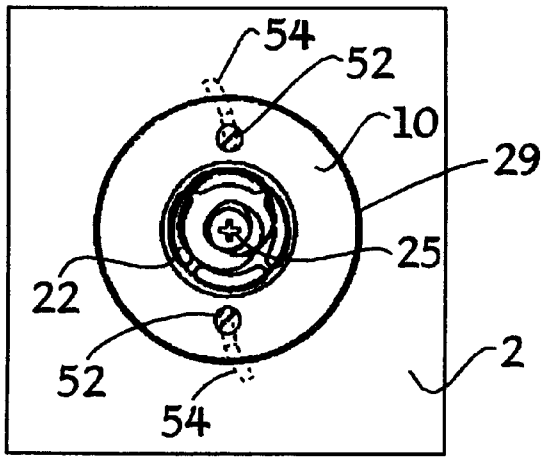
FIG. 4. is an end view of the top portion of the Front Mounting Socket of the present invention mounted on a sign substrate.
Figure 5:
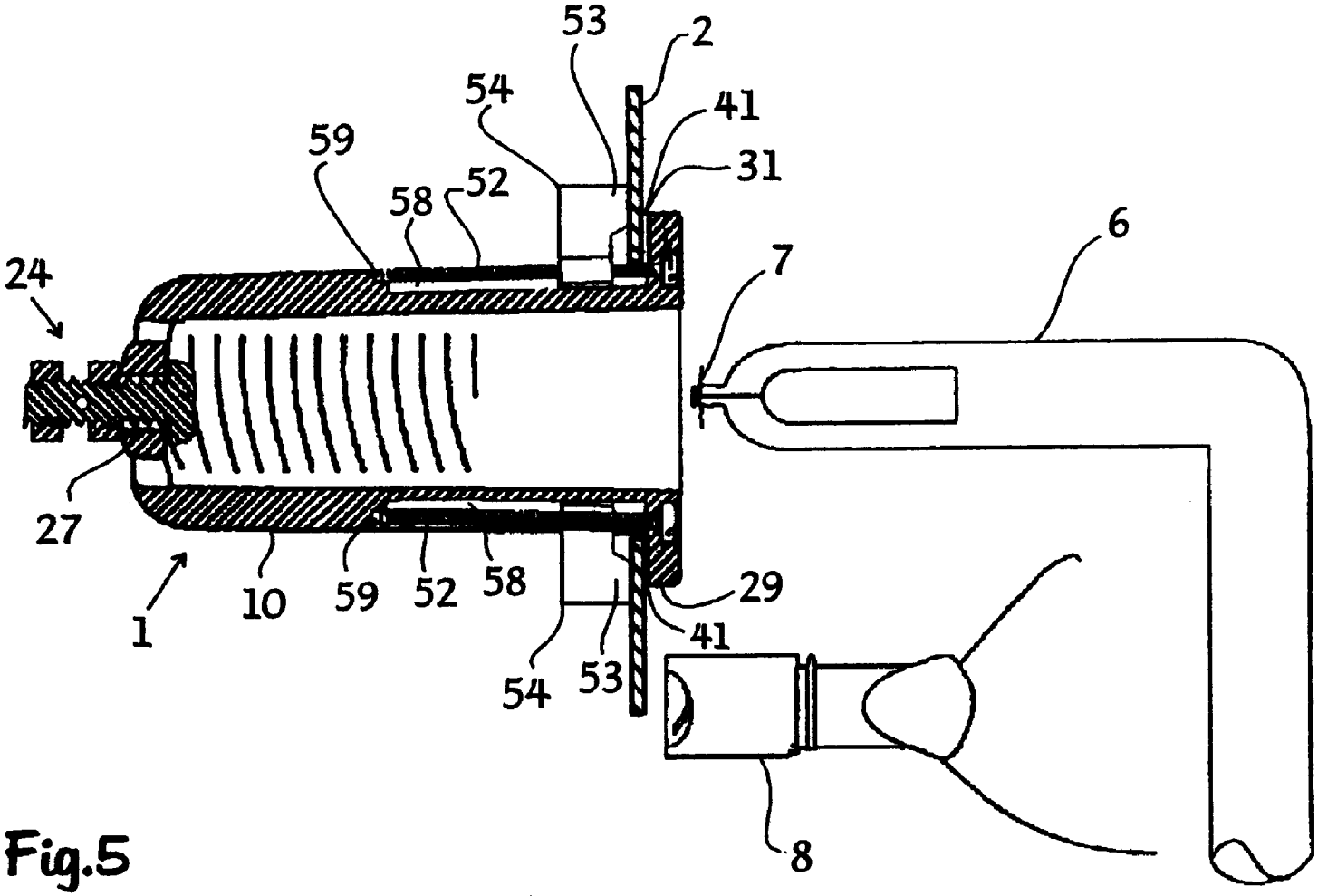
FIG. 5. is a side elevation section view of the Front Mounting Socket illustrated in FIG. 1 with the retainer clips abutting the sign substrate and interposing the sign substrate between each retainer member and the retaining surface.

The bottom portion 20 of the socket body 10 is provided with a plurality of drain holes 22 and a centrally located wire terminal 24 in a terminal hole 27. The socket body 10 is an elongated, closed end tube with a central cavity 11. The drain holes 22 and the terminal hole 27 are in communication with the cavity. The drain holes 22 allow moisture, which may accumulate in the cavity 11 of the socket body 10, to exit said socket 10. Since some gas light tube signs are exposed to moisture in outdoor signs, such drain holes 22 are advantageous. The drain holes 22 can best be seen in FIG. 4. The illustrated drain holes are arcuate slots but they can be in an convenient shape, configuration and number. In some applications, the drain holes 22 may not be necessary so the socket body 10 will not have drain holes in communication with the cavity 11. One embodiment of the present invention provides removable covers over the drain holes 22, which covers may selectively be removed by the operator. Such covers can be of the "knockout" type.

The socket body can be made of a dielectric material which is electrically insulating and resilient. The wire terminal 24 illustrated consists of a bolt 25 secured in the terminal hole 27 of the socket body 10 by a nut 26. The bolt 25 is in communication with the cavity 11 and secures an electrode contact spring 36 in the cavity 11 of the socket body 10. A second nut 26 secures a wire 4 to the wire terminal 24. The wire 4 provides an electrical connection to the front mounting socket 1 to power the gas light tube 6. A gas light tube 6 is provided with an electrode contact 7 at each of its ends (See FIGS. 1 and 5). The electrode contact 7 mechanically contacts the electrode contact spring 36 when the gas light tube 6 is inserted into the socket body 10 of the front mounting socket 1 of the present invention. The gas tube 6 may be supported by one or more support members 8. The sign surface substrate 2 has an aperture 3 into which the socket body 10 is inserted.

The socket body is provided with two diametrically positioned retaining clips 50 with each retaining clip 50 comprising a retainer member 54 and a screw member 52 supported in a screw groove 58 formed in the socket body 10 and pivotly mounted in a pivot socket 59 at one end of the screw groove 58, with the retainer member 54 threadingly engaged on the screw member 52, the screw member 52 extending from the top portion 28 of the socket body 10 to the mid-portion 23 of the socket body 10. Each retaining member 54 may be provided with a retaining lip 53 with said retaining lip 53 being a raised portion defining a retaining surface that engages the sign surface substrate 2 when the socket body 10 is inserted into the aperture 3 and the screw member 52 is turned to cause the retainer member 54 to move along the screw member 52 towards the sign substrate 2. Another embodiment provides for the retainer member 54 to be curved. The socket body 10 and the retainer member can be molded in or machined from a suitable, dielectric material such as plastic, nylon or the like, rated for the required temperatures and electrical requirements.

After connecting an electrical wire 4 to the wire terminal 24, the socket body 10 is installed in a gas light tube sign. The socket body 10 is inserted in an aperture 3 of the sign surface substrate 2 until the annular mounting surface 31 abuts the sign surface substrate 2. During the insertion procedure, the retainer members 54 are nested in the retainer recess 56. When the socket 1 is fully inserted into the aperture 3, the operator turns each screw member 52 thereby causing the retainer member 54 to emerge from the retainer recess 56 and move along the screw member 52 until the retainer member 54 abuts the sign substrate 2 and tightening each screw member 52 thereby interposing the sign substrate 2 between each retainer member 54 and the retaining surface 31 of the mounting surface 41 which secures the socket 1 to the sign.

The gas light tube is usually an elongated glass tube containing a gas such as neon. Each end of the glass tube has an electrode contact 7. The glass tube is supported above the sign surface substrate 2 by several tube supports 8. The glass tube is inserted into the cavity 11 of the socket body 10 and makes mechanical and electrical contact with the electrode contact spring 36. The glass tube is maintained in the socket body 10 by tube retaining wires attached to the tube supports in a conventional manner.

Thus, it should be apparent that there has been provided in accordance with the present invention a front mounting socket for a gas light tube sign and a method for installing and a method for removing a front mounting socket in a sign that satisfies the objectives and advantages set forth above. Although the invention has been described in conjunction with specific embodiments thereof, it is evident that many alternatives, modifications and variations will be apparent to those skilled in the art. Accordingly, it is intended to embrace all such alternatives, modifications and variations that fall within the spirit and broad scope of the appended claims.

I claim:

1. A front mounting socket for a gas light tube, which socket is mounted in an aperture in a sign surface substrate, said socket comprising:

a socket body having a top portion with a mounting rim a part of which form an annular mounting surface near the top portion of the socket body, with said mounting rim having a raised portion defining a retaining surface that engages the sign surface substrate, and a mid portion, and a bottom portion having a wire terminal with said wire terminal in communication with a cavity in the socket body, said socket body further provided with two diametrically positioned retaining clips with each retaining clip comprising:

a retainer member, and a screw member supported in a screw groove formed in the socket body and pivotly mounted in a pivot socket at one end of the screw groove, with the retainer member threadingly engaged on the screw member, the screw member extending from the top portion of the socket body to the mid-portion of the socket body; and, an electrode contact spring positioned in the cavity of the socket body and in electrical contact with the wire terminal.

2. The front mounting socket of claim 1 wherein the socket body comprises a dielectric member.

3. The front mounting socket of claim 1 wherein each retaining member is curved.

4. The front mounting socket of claim 1 wherein the bottom portion of the socket body is provided with a plurality of drain holes.

5. The front mounting socket of claim 4 wherein the bottom portion of the socket body is provided with a plurality of removable covers for the drain holes.

6. A method for securing a front mounting socket in a sign having a sign surface substrate with said substrate having at least one aperture, said method comprising:

connecting an electrical wire to a wire terminal on a front mounting socket, said socket having two diametrically positioned retaining clips with each retaining clip comprising:

a retainer member, and a screw member supported in a screw groove formed in the socket body and pivotly mounted in a pivot socket at one end of the screw groove, with the retainer member threadingly engaged on the screw member, the screw member extending from the top portion of the socket body to the mid-portion of the socket body;

inserting the front mounting socket into the aperture in the sign surface substrate until the retaining surface, abuts the sign surface substrate; and, tightening each screw member until the retainer member abuts the sign substrate, thereby interposing the sign substrate between each retainer member and the retaining surface of the mounting surface which secures the socket to the sign.

7. The method of claim 6 including the step of removing a cover from a drain hole in the front mounting socket.

8. A front mounting socket for a gas light tube, which socket is composed of dielectric material and is mounted in an aperture in a sign surface substrate, said socket comprising:

a socket body having a top portion with a mounting rim a part of which form an annular mounting surface near the top portion of the socket body, with said mounting rim having a raised portion defining a retaining surface that engages the sign surface substrate, and a mid portion, and a bottom portion having a wire terminal with said wire terminal within a cavity in the socket body;

a plurality of means for securing the socket to the sign substrate; and, an electrode contact spring positioned in the cavity of the socket body and in electrical contact with the wire terminal;

wherein the plurality of means for securing is a pair of retaining clips positioned in the mounting rim, with each retaining clip comprising:

a retainer member, and a screw member supported in a screw groove formed in the socket body and pivotly mounted in a pivot socket at one end of the screw groove, with the retainer member threadingly engaged on the screw member, the screw member extending from the top portion of the socket body to the mid-portion of the socket body.

9. The front mounting socket of claim 8 wherein the retaining members are diametrically positioned in the mounting rim.

10. The front mounting socket of claim 9 wherein each retaining member is curved.

11. The front mounting socket of claim 8 wherein the bottom portion of the socket body is provided with a plurality of drain holes.

12. The front mounting socket of claim 11 wherein the bottom portion of the socket body is provided with a plurality of removable covers for the drain holes.

* * * * *